US006447365B1

(12) United States Patent
Powell et al.

(10) Patent No.: US 6,447,365 B1
(45) Date of Patent: Sep. 10, 2002

(54) BRASSIERE INCLUDING BREAST-SUPPORTING INSERTS

(75) Inventors: David Powell, Loxwood; Richard Seymour, Kingston-upon-Thames, both of (GB)

(73) Assignee: Charnos PLC, Derbyshire (GB)

( * ) Notice: Subject to any disclaimer, the term of this patent is extended or adjusted under 35 U.S.C. 154(b) by 0 days.

(21) Appl. No.: 09/646,073

(22) PCT Filed: Mar. 24, 1999

(86) PCT No.: PCT/GB99/00925

§ 371 (c)(1),
(2), (4) Date: Sep. 13, 2000

(87) PCT Pub. No.: WO99/48392

PCT Pub. Date: Sep. 30, 1999

(30) Foreign Application Priority Data

Mar. 24, 1998 (GB) ..... 9806143

(51) Int. Cl.[7] ..... A41C 3/00
(52) U.S. Cl. ..... 450/41; 450/86
(58) Field of Search ..... 450/41–53, 54–56, 450/60–79, 80, 86

(56) References Cited

U.S. PATENT DOCUMENTS 2,621,328 A * 12/1952 Duchnofskey ..... 450/41
3,021,844 A * 2/1962 Flagg et al. ..... 450/41
3,021,845 A * 2/1962 Smith ..... 450/41
3,026,227 A * 3/1962 Flagg et al. ..... 450/41
3,146,779 A * 9/1964 Flagg et al. ..... 450/41
3,163,167 A * 12/1964 Chisolm ..... 450/41
3,176,686 A * 4/1965 Barnes ..... 450/1
4,143,662 A * 3/1979 Fisher ..... 450/41
5,660,577 A * 8/1997 Modena ..... 450/41

FOREIGN PATENT DOCUMENTS

FR 970 795 A 1/1951
GB 413 228 A 7/1934

OTHER PUBLICATIONS

Patent Abstracts of Japan; "Core Material for Brassiere"; Shindo Fujio; Kato Hatsujo Kaisha Ltd; vol. 014, No. 543 (C–0783); JP 02 229204 A; Published Sep. 12, 1990.

* cited by examiner

*Primary Examiner*—Gloria M. Hale
(74) *Attorney, Agent, or Firm*—Adams, Schwartz & Evans, P.A.

(57) ABSTRACT

An undergarment, normally a bra, includes in each of its cups (12) an insert (20) comprising a moulded elastomeric surround (24, 28) and a relatively more rigid armature (22) embedded in the surround, the insert extending, in use, around the lower breast profile and upwardly and outwardly therefrom.

10 Claims, 2 Drawing Sheets

BRASSIERE INCLUDING BREAST-SUPPORTING INSERTS

This application is a national stage application, according to Chapter II of the Patent Cooperation Treaty. This application claims the priority date of Mar. 24, 1998 for Great Britain Patent Application No. 9806143.5.

The invention relates to women's undergarments, and particularly to bras.

Conventional bras consist of cups, which provide support for the breasts, and straps which fasten around the thorax and over the shoulders to keep the cups in place. Such bras are often "underwired", in order to provide improved support and shape. A piece of approximately semi-circular flattened wire is stitched into each cup of the bra such that when the bra is in place, the wire defines the base and the side of the cup adjacent to the ribcage.

Such conventional bras suffer from a number of disadvantages. The wire can cause discomfort by pressing against the ribs of the wearer or digging into the flesh in the underarm region. The abrupt end of the supporting wire in this region may also result in flesh bulging out over the top or around the edges of the bra ("double busting"). In addition, the wires can work loose at their ends, and protrude from the fabric of the bra. As a result of the rigid nature of the wires they require cushioning to reduce discomfort and this adds to the number of components in the garment which may be as many as fifty two.

Further discomfort may be caused by the fact that the wire is flat in section in order to withstand tension from the back strap and is essentially two-dimensional, rather than being formed to the shape of the body.

The wire also tends to cause fraying of the fabric around it, which needs extensive softening to make it acceptable to the wearer. Because of this, machine washing of underwired bras is not recommended.

According to the invention there is provided an undergarment including fabric breast supporting cups in which an insert is included in each cup, the insert, in use, extending around the lower breast profile and upwardly and outwardly away from the lower breast profile.

By "lower breast profile" it is meant the approximate line of contact between the breast and the rib area, at the base of the breast.

Preferably the insert maintains substantially the same shape when not in use as when in use.

The fabric cups may include outer and inner layers of material between which the insert is located. The insert may be stitched directly to the fabric.

Preferably the insert includes a portion which conforms approximately to the shape of the underside of a wearer's breast when supported by a bra.

Preferably the insert includes a substantially rigid armature, preferably comprising a polycarbonate component. The armature may be substantially "U" shaped, and preferably includes a portion which in use extends upwardly and outwardly away from the wearer's lower breast profile.

Preferably the insert includes a moulded component, which may be elastomeric. Preferably the moulded component includes a portion which in use extends upwardly and outwardly away from the wearer's lower breast profile.

Preferably the insert includes a polycarbonate armature and a moulded surround which is preferably elastomeric. The surround may include a feather edge.

The surround may include a portion which encloses the armature and a portion which extends towards the underarm area of a wearer. Perforations may be provided in the surround.

According to the invention there is further provided an insert for a bra, the insert being as defined in any of the preceding nine paragraphs.

An embodiment of the invention will be described for the purposes of illustration only with reference to the accompanying drawing in which.

Figure 1:
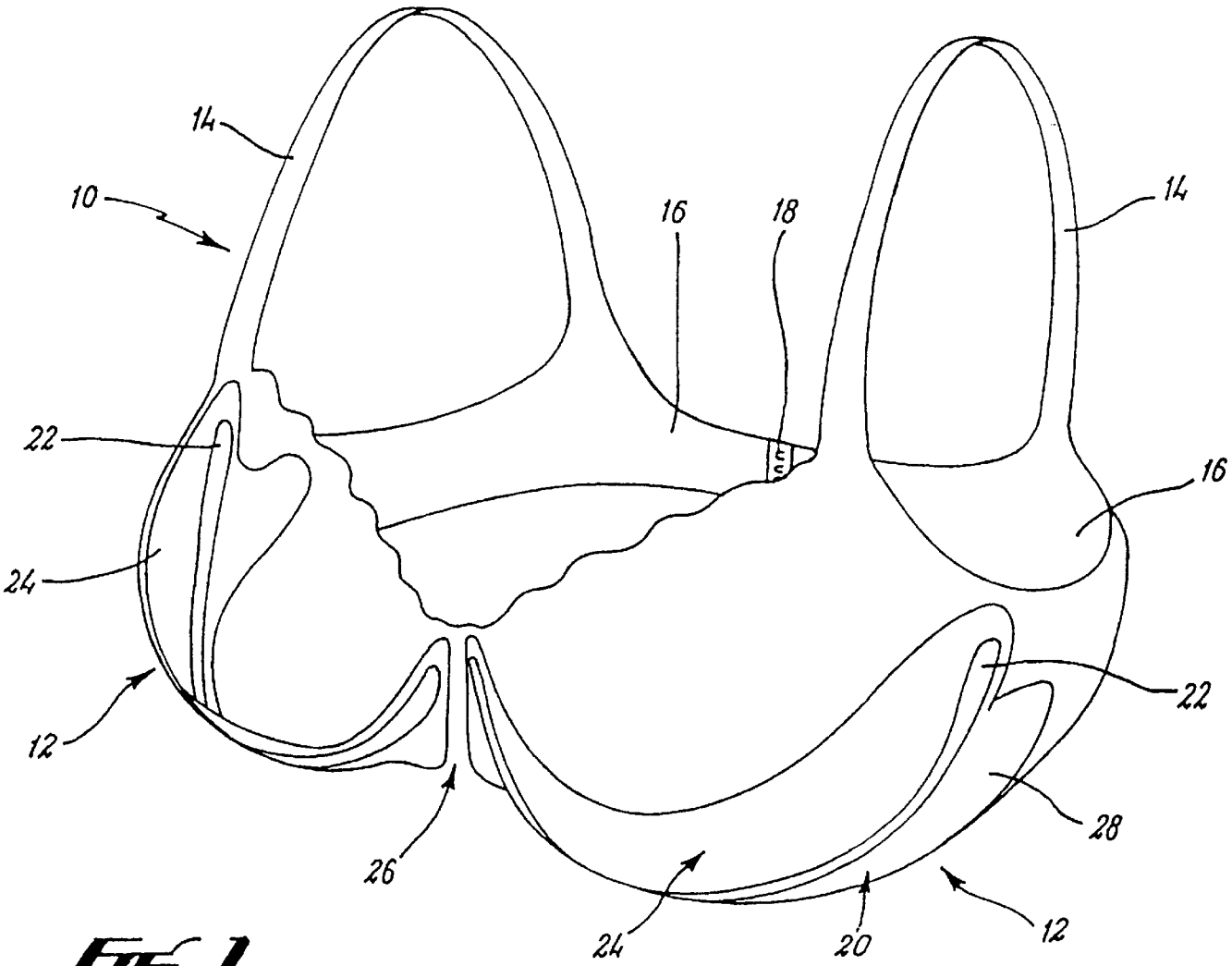
FIG. 1 is a diagrammatic perspective view of a bra according to the invention.

The internal components of the bra and the insert are illustrated in the drawing although they would not in reality be visible or as clearly visible as suggested by the drawings.

The bra 10 includes a pair of cups 12 and a pair of shoulder straps 14, one shoulder strap 14 being associated with each cup. Extending from an outer edge of each cup is a back strap 16, the two back straps 16 being joinable at the back of a wearer by a fastener 18. The shoulder straps 14 extend from an upper part of their respective cup over the wearer's shoulders and are attached to the back strap 16. The system of back and shoulder straps thus maintains the cups in place.

The shoulder and back straps are made of a fabric material which preferably includes an elastomeric component such as elastane. The external material of the cups 12 is also fabric which preferably also has an element of elasticity. At least a lower region of each cup includes outer and inner layers of fabric and located between the outer and inner layers is an insert 20, as described below and illustrated in greater detail in FIG. 2.

Each cup includes an insert 20 consisting of an approximately U-shaped polycarbonate armature 22 embedded in an elastomeric surround 24. The armature 22 is substantially rigid and provides a framework for supporting the breast. The armature in use extends from a central region 26 between the breasts, curves underneath the breast along the lower breast profile and then extends upwardly and outwardly away from the lower breast profile towards the front of the shoulder.

Figure 2:
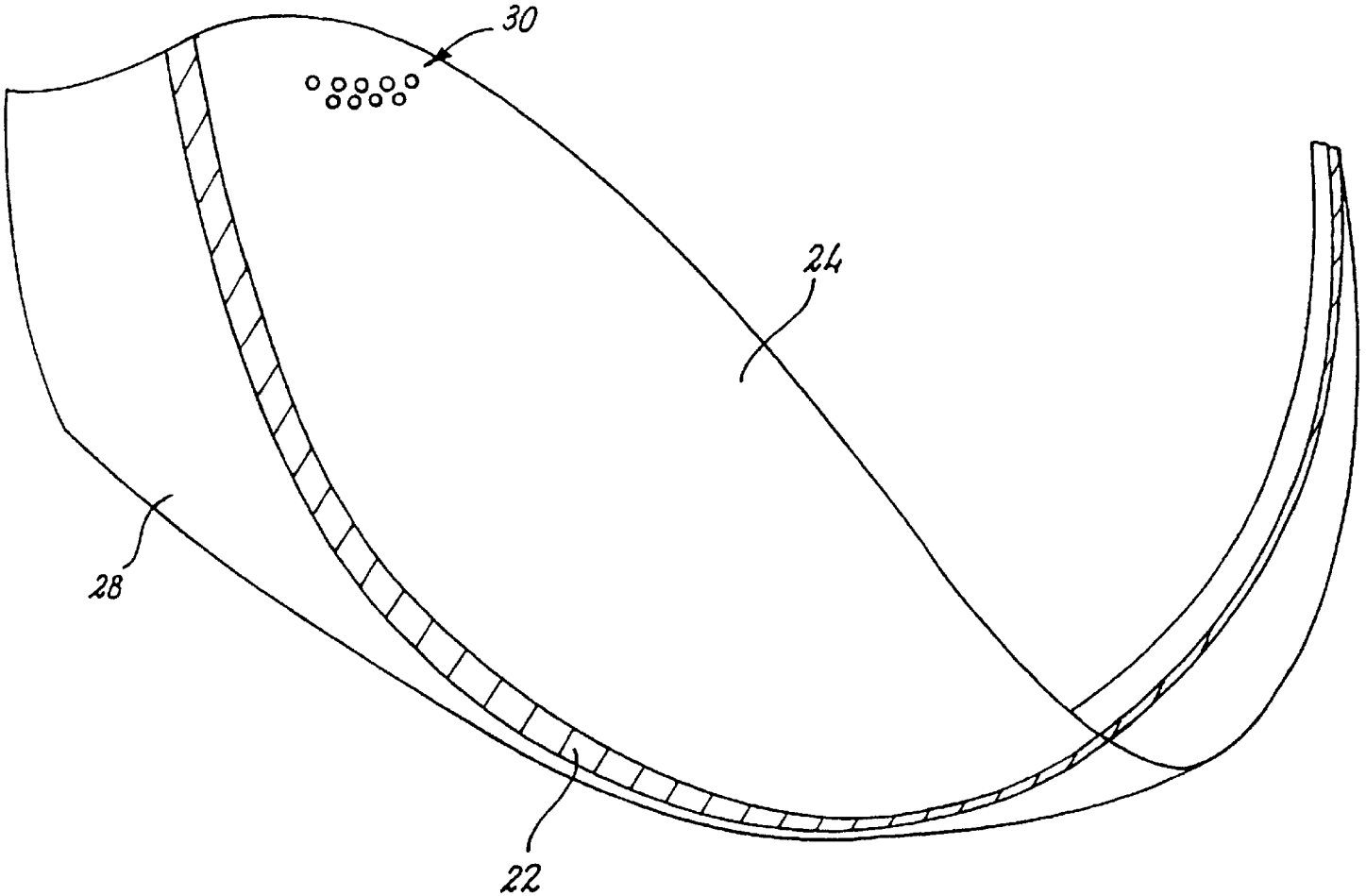
FIG. 2 is a perspective view of an insert for a bra which is modified when compared with that shown in FIG. 1.

The elastomeric surround 24 is relatively flexible and soft, cushions the breast from the rigid armature and provides support in upwards and outwards directions for the breast. The surround 24 is moulded to conform to the shape of the lower region of the breast supported by the armature. It is thicker at its central regions and reduces in thickness towards its upper edge and outer ends. It is shaped as illustrated in FIG. 2. The surround extends generally outwardly from the armature and then curves upwardly. It is of greater width at its underarm end than at its between breasts end. The surround thus ensures that the support provided by the armature is not concentrated on one narrow band; instead the whole of the lower region of the breast is cradled by the insert. The surround 24 includes an underarm extension 28 and contain the wearer's flesh in the underarm region to reduce the tendency for the flesh to bulge and to increase comfort. The surround 24 is stitched into the fabric of the cup 12 to keep the insert in place and prevent the various elements of the bra moving relative to one another. The edges of the armature and surround are feathered, that is decrease in thickness at their edges and any relatively thick edges for example, at the ends of the armature, are rounded.

There is thus provided a bra which supports the breasts effectively and comfortably in a natural position. The armature 22 provides firm support, while the surround 24 ensures comfort and further support and uplift for the wearer. Not only does the soft, pliable nature of the surround enhance support, comfort etc. but it readily enables different breast shapes and sizes to conform to the insert shape and this, with other features of the bra of the invention, enables a single bra to cover a greater range of sizes than an existing bra. The invention also enables a reduction in the number of components required to make the bra. The bra is also of considerable assistance to women who have experienced breast surgery.

Perforations 30, only some of which are shown in FIG. 2 are formed through the surround 24, 28 to improve its breathability.

The insert is injection moulded, with the armature 22 being moulded from a polycarbonate material which may be reinforced with glass fibres. This gives the armature the appropriate rigidity while still offering a limited degree of flexibility. A further injection moulding process which may be part of a two pass process involves injecting moulding the surround 24 and its extension 28 around the armature. The material from which the surround is moulded has properties similar to a cross-linked rubber and is chosen from the group comprising styrene ethylene-butylene styrene, styrene ethylene-propylene styrene, polyether block amides, polyolefin elastomer. It is unlikely that vulcanisation will be necessary.

It may be possible to utilise the material from which the surround is moulded for the armature. The material constituents and the moulding process may be altered to provide the necessary extra rigidity.

Various modifications may be made to the above bra without departing from the invention. The armatures need not be polycarbonate but may be made of any material sufficiently rigid in use to provide a firm framework for the breast. For example, wire armatures may be used. The size and shape of the inserts will vary depending upon the size of the bra. The bra may have a front fastening located between the breasts instead of the fastener 18 and means may be provided for adjusting the length of the shoulder straps and the back strap. Rather than being located between two layer of fabric of the cup 20, the insert may be stitched directly to the surrounding fabric of the bra or it may be heat sealed to the inner side of a single layer of fabric forming the cup.

What is claimed is:

1. An undergarment comprising fabric breast supporting cups (12), each comprising an insert (20) having a substantially rigid and substantially U-shaped armature (22) wholly enclosed in a surround (24,28) of an elastomeric material, wherein when the undergarment is being worn, the armature (22) extends from a central region between a wearer's breasts, curves underneath the breasts along a lower breast profile of the wearer and then extends upwardly and outwardly away from the lower breast profile towards an underarm area of the wearer.

2. An undergarment as claimed in claim 1, wherein the insert (20) includes a portion which conforms approximately to the shape of the underside of a wearer's breast.

3. An undergarment as claimed in claim 2, wherein the insert includes also an underarm portion (28) which extends towards the underarm area of the wearer.

4. An undergarment as claimed in claim 1, wherein the armature (22) is moulded from a polycarbonate material.

5. An undergarment as claimed in claim 1, wherein the elastomeric material is selected from the group consisting of styrene ethylene-butylene styrene, styrene ethylene-propylene styrene, polyether block amides, and polyolefin elastomer.

6. An undergarment as claimed in claim 1, wherein the surround (24, 28) is perforated.

7. An undergarment as claimed in claim 1, wherein the insert (20) is included between two layers of fabric.

8. An undergarment as claimed in claim 1, wherein the insert (20) is directly stitched to the fabric of the undergarment.

9. An undergarment as claimed in claim 1, wherein the insert (20) is heat sealed to at least one layer of fabric forming the undergarment.

10. An insert (20) for an undergarment as claimed in claim 1, the insert comprising a substantially rigid and substantially U-shaped armature (22) wholly enclosed in a surround (24,28) of an elastomeric material, wherein the armature is adapted, when the undergarment is being worn, to extend from a central region between a wearer's breasts, curve underneath the breasts along a lower breast profile of the wearer and then extend upwardly and outwardly away from the lower breast profile towards an underarm area of the wearer.

* * * * *